United States Patent [19]

Cunningham

[11] Patent Number: 4,693,449

[45] Date of Patent: Sep. 15, 1987

[54] BEAM FORM AND SLAB FORM ADJUSTMENT STRUCTURE

[76] Inventor: Arthur L. Cunningham, 6055 Windemere Way, Riverside, Calif. 92506

[21] Appl. No.: 790,864

[22] Filed: Oct. 24, 1985

[51] Int. Cl.[4] ..... E04G 1/20

[52] U.S. Cl. ..... 249/210; 249/28; 249/50

[58] Field of Search ..... 249/24, 28, 29, 30, 249/50, 210, 18, 20, 13; 182/12, 155, 178

[56] References Cited

U.S. PATENT DOCUMENTS

| | | | |
|---|---|---|---|
| 3,162,922 | 12/1964 | Alziari | 249/29 |
| 4,123,032 | 10/1978 | Teschner | 249/29 |
| 4,227,672 | 10/1980 | Cunningham | 249/28 |
| 4,470,574 | 9/1984 | Jackson | 249/29 |

FOREIGN PATENT DOCUMENTS

| | | | |
|---|---|---|---|
| 0121744 | 10/1984 | European Pat. Off. | 249/28 |
| 1807257 | 2/1970 | Fed. Rep. of Germany | 249/28 |
| 616935 | 2/1961 | Italy | 249/28 |
| 1534870 | 12/1978 | United Kingdom | 249/28 |

*Primary Examiner*—Jay H. Woo
*Assistant Examiner*—James C. Housel
*Attorney, Agent, or Firm*—Fulwider, Patton, Rieber, Lee & Utecht

[57] ABSTRACT

A beam form and slab form adjustment structure adapted for detachable mounting to a shoring frame of generally standard construction. Existing shoring frames with the present adjustment structure are useful in supporting and precisely aligning beam and slab forms relative to the vertical columns of a building. The adjustment structure includes a hinge arrangement enabling the associated shoring frame to retract so that the beam and slab forms can be moved for reuse at the next concrete pouring station.

10 Claims, 6 Drawing Figures

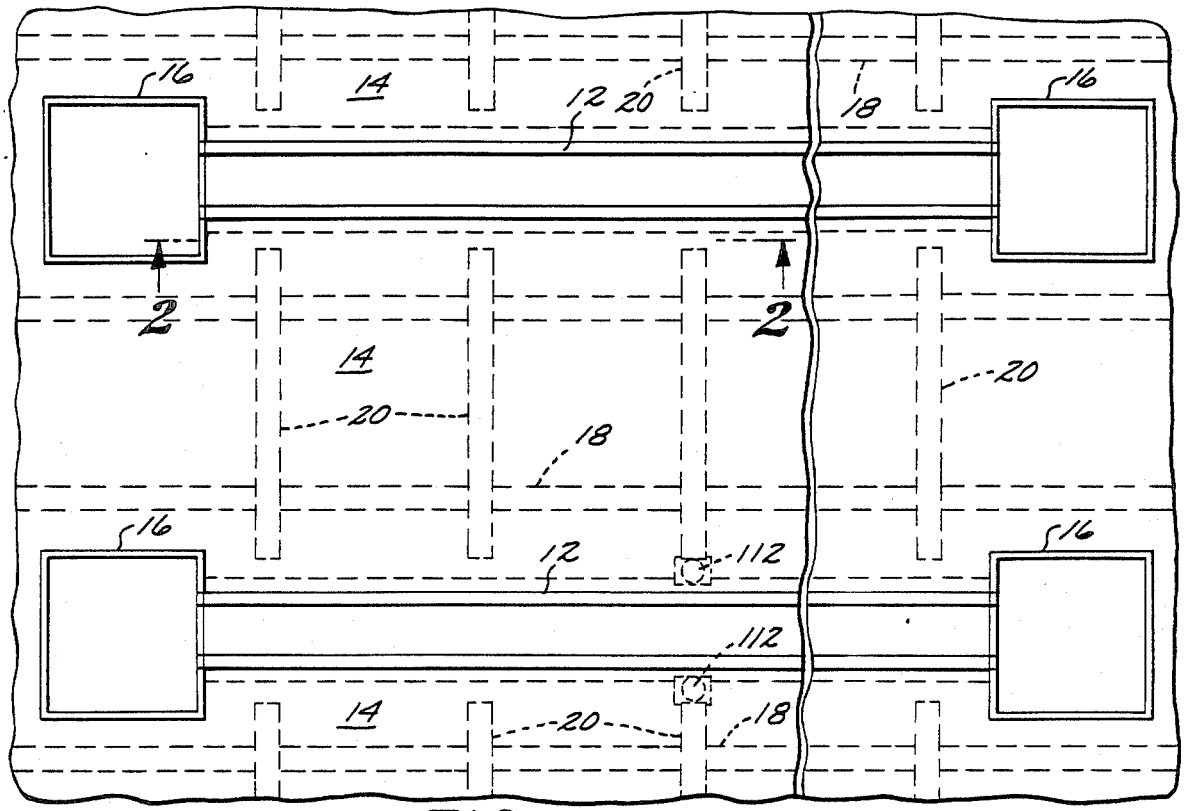
FIG. 1
FIG. 2
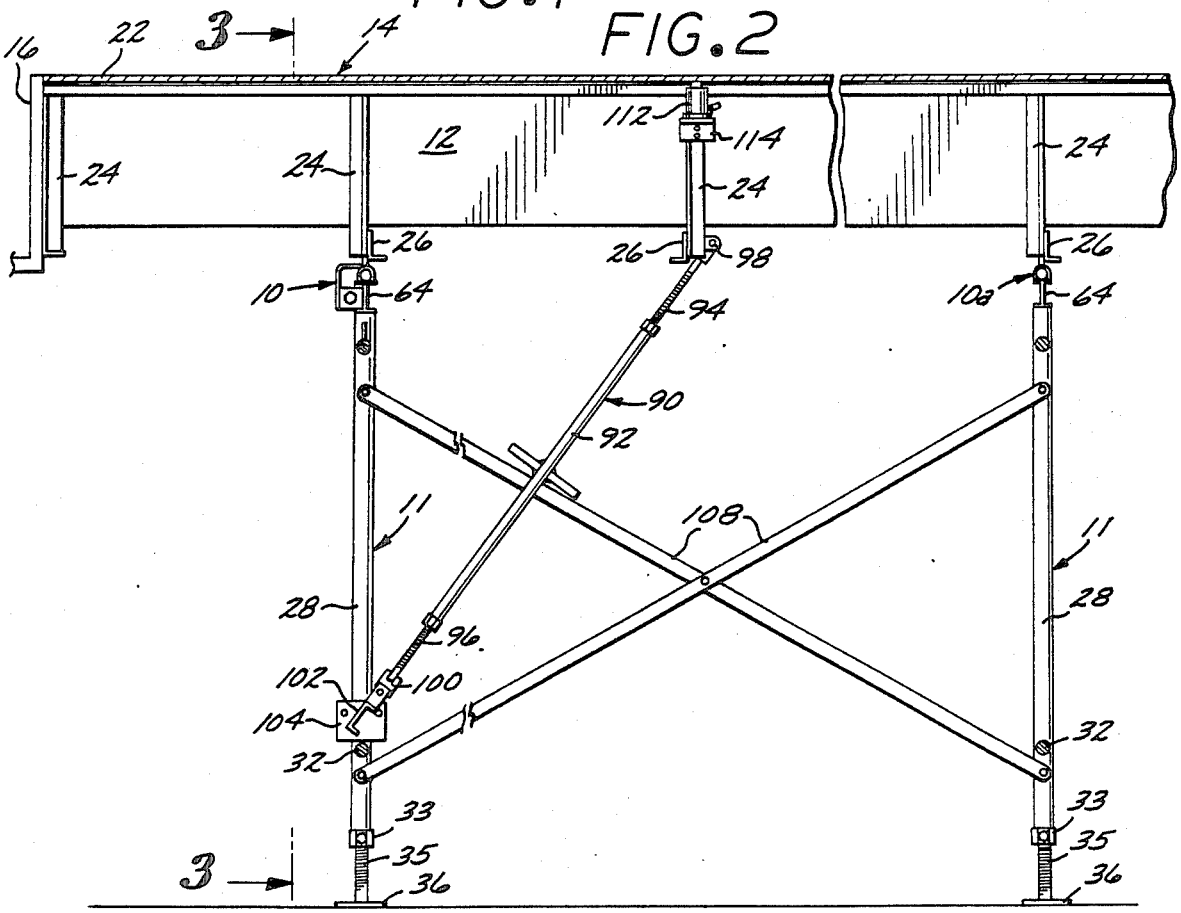

BEAM FORM AND SLAB FORM ADJUSTMENT STRUCTURE

BACKGROUND OF THE INVENTION

1. Field of the Invention

The present invention relates to beam form and slab form adjustment structure, and particularly to a beam form and slab form adjustment structure for detachable association with generally standard shoring frames whereby such frames can be adapted for repetitive use in supporting and aligning beam and slab forms at successive concrete pouring stations.

2. Description of the Prior Art

In constructing floor slabs and beams for high rise buildings, parking garages, or the like, forming structures are required to support each concrete slab and beam during pouring and curing. One method of the prior art involves piecemeal, in-place construction of the forms, using steel sections, scaffolding, plywood sheeting and the like. After the concrete has been poured and cured, the complete form structure is taken apart and the components salvaged as much as possible for assembly at the next pouring station. An inordinate amount of labor and a building materials is wasted.

To avoid the high material and labor costs of such a process, another prior art method utilizes a monolithic or integral form structure capable of being placed in position for forming and supporting a concrete structures during curing. Such a monolithic structure is adapted to be removed and relocated or "flown" to the next concrete pouring station by means of cranes or rolling dollies. The use of dollies is especially efficient for parking garages where the equipment can be rolled to a new pouring position using the ramps formed from earlier pours. Typically, the form is lowered and stripped from the poured structure, moved outwardly to a point where hoisting cables can be attached, and then moved laterally to an adjacent bay, or hoisted upwardly for use at the next higher floor level. If dollies are used, the stripped form is simply lowered onto the dollies for transport to the next pouring station.

Although costs are greatly reduced through the use of a monolithic integral form, it has been found difficult to precisely align such a form with the centerlines of associated building columns. A great deal of cutting and fitting and tailoring is required to exactly mate the beam form and slab form with each other and with the columns. Many of these problems are avoided by another system of the prior are, as disclosed in U.S. Pat. No. 4,227,672, issued Oct. 14, 1980 for "Beam Form and Shoring Structure". A special shoring frame is disclosed which includes both beam form and slab form supporting and adjusting means. The shoring frame is a specialized structure which is different from the typical shoring frame which is presently widely used and available in the inventory of contractors. Consequently, the advantages of the patented structure can only be obtained by using the specially designed shoring frames.

SUMMARY OF THE INVENTION

According to the present invention, a beam form and slab form adjusting structure is provided which is adapted for detachable mounting to the usual type of shoring frame which is characterized by a pair of upstanding tubular legs. The present structure includes a pair of slab form supports carried by height adjustment means which slip into the open upper ends of the tubular legs of the usual shoring frame. The structure also includes beam form support hinged to. Lateral adjustment means are provided to adjust the lateral position of the beam form support means relative to the slab form supports.

A plurality of the structures can be detachably mounted to typical standard shoring frames of the type mentioned to support and alignment of slab and beam forms at a concrete pouring station, and the rapid stripping of such forms from the poured beam and slabs. The hinge connections enable easy retraction of the shoring frames for their transport and reuse at successive pouring stations.

The present adjusting structures thus can be mounted to standard frames to provide all the advantages of specialized shoring frame, but at a fraction of the cost.

Other objects and features of the invention will become apparent from consideration of the following description taken in connection with the accompanying drawings.

BRIEF DESCRIPTION OF THE DRAWINGS

FIG. 1 is a partial plan view of the beams, vertical columns and slabs of a building structure, one of the present beam form and slab form adjusting structures being shown in association with typical beam and slab forms;

FIG. 2 is an enlarged view taken along line 2—2 of FIG. 1;

DESCRIPTION OF THE PREFERRED EMBODIMENT

Figure 3:
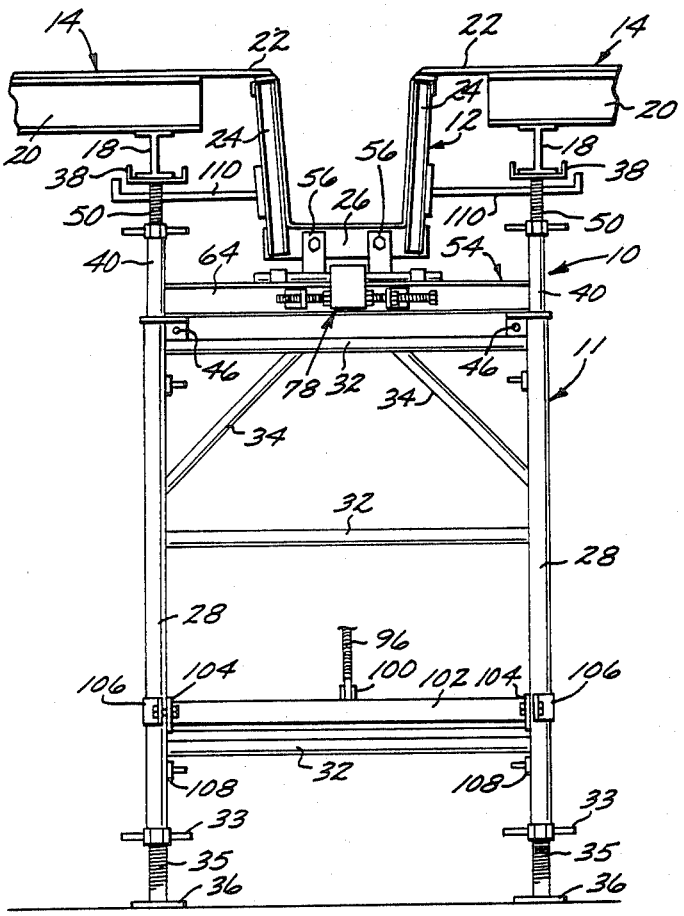
FIG. 3 is taken along line 3—3 of FIG. 2.

Referring now to the drawings, and particularly to FIGS. 1–3, there is illustrated a beam form and slab form adjustment structure 10 adapted for detachable association with a widely used and available type of prior art shoring frame 11. A number of frames 11 are typically employed along the length of a beam form 12 to support the beam form 12 and associated slab forms 14 relative to the vertical columns 16 of a building. The particular application illustrated and described in the present disclosure is merely exemplary since the size, location, and general arrangement of beams and slabs in various building applications can and do vary greatly.

Frame 11, together with a plurality of structures 10, have been found to work extremely well for forming multistory concrete parking structures in which the beams are as long as 60 to 65 feet or more. The beams provide large open spans for parking between the columns 16. In the drawings, only a few of the columns 16 and slab forms 14 are illustrated, for brevity.

A typical slab form 14 comprises a plurality of elongated, laterally spaced-apart I-beams 18 underlying and supporting a plurality of transverse, longitudinally spaced apart joists 20. A wooden deck 22 made of plywood or the like overlies and is supported by the joists 20. The deck 22 is the surface onto which the floor slab (not shown) is poured.

The beams 18 and joists 20 are preferably made of aluminum for light weight, but their particular structure and material, as well as that of the beam form 12 and slab form 14 may vary greatly, depending upon available materials, the span involved, and the like. However, the slab form 14 preferably includes beams 18 or their equivalent because the beams 18 provide a convenient means by which the forms 14 can be supported.

As seen in FIG. 2, a plurality of shoring frames 11 are located long the length of a beam form 12 to support the from and the adjacent pair of slab forms 14 during pouring of the slab and beam. It is common where the slab spans a considerable distance to provide additional supports in the form of center post shores (not shown) disposed beneath the beam form 12.

Each beam form 12 is generally channel shape, elongated and upwardly open. It includes upwardly divergent sides to provide a draft to facilitate stripping of the beam form 12 away from the poured beam. It is preferably made of a formed steel section capped at its upper side edges by angles which mount wooden strips to enable the wooden deck 22 to be nailed to it. Of course, if desired, the beam form itself could be made of wood.

The beam form 12 is strengthened against deflection under the load of the poured concrete by vertically disposed side channels 24 located along the beam at longitudinally spaced intervals and at the end. Each pair of channels 24 are fixed to a bottom channel 26 welded to the underside of the beam form 12. The end ones of the channels 24 and 26 are provided with mounting openings (not shown) for connection to similar channels of another beam form to enable fabrication of long spans.

The beam form 12 must be located in exact alignment with the centerlines of the columns 16 and at the exact height to place the top of the beam form 12 in the horizontal plane of the adjacent dicks 20 of the slab forms 14.

As previously indicated, each shoring frame 11 is of usual or standard construction, and is generally in the inventory of a contractor or conveniently available to the contractor. The present adjustment structure 11 adapts each of the end frames 11 with which it is associated to perform a support and alignment function heretofore provided only by specialized single purpose shoring frames, such as described in the previously mentioned U.S. Pat. No. 4,227,672. The frames 11 intermediate the end frames perform a similar function except, as will be seen, they do not provide for lateral adjustment of the beam form 12.

A plurality of the frames 11 are spaced apart along the length of and at the ends of a beam form 12. Each frame 11 includes a pair of vertically disposed, laterally spaced apart tubular side portions or legs 28. Transverse and diagonal members or braces 32 and 34, respectively, are welded to the legs 28 for structural rigidity.

The usual shoring frame 11 is not adapted to bear the weight of the beam and slab forms 12 and 14 filled with concrete, not is it adapted to adjust the vertical height of the slab forms 14 or the transverse alignment of the beam form 12. These functions are provided by the present adjustment structure 10 when it is mounted to a shoring frame 11 and, as will be seen, the structure 10 is adapted to be quickly and easily mountable to such a shoring frame, and easily removable for re-use with a different shoring frame.

Figure 4:
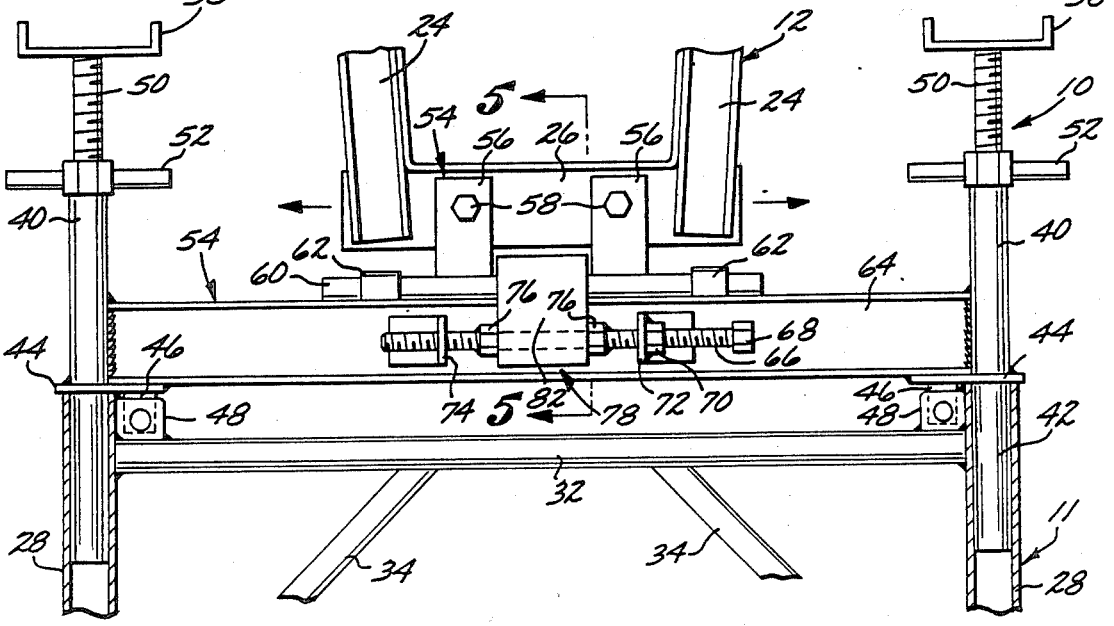
FIG. 4 is an end elevational view of the upper portion of the shoring frame illustrated in FIG. 2.

The adjustment structure 10 comprises, generally, a pair of slab from support means which includes a pair of upwardly open channels or supports 38 for engaging or receiving the I-beams 18 of the slab forms 14, as best seen in FIG. 4 and a pair of height adjusting means mounting the supports 38. Each height adjusting means includes a tubular element 40 having a depending portion 42 telescopably and removably receivable within the upper extremity of an associated frame leg 28. A horizontal stop or tab 44 is welded to each tubular element 40 and engages the top of the leg 28, to establish the height of the support 38 above the leg 28.

Each tab 44 includes a depending integral apertured bracket 46 locatable adjacent a similar apertured bracket 48 welded to the adjacent frame leg 28 and the brace 32. Suitable fasteners (not shown) are disposed through the apertures in brackets 46 and 48 to removably secure the adjustment structure 10 against inadvertent separation from the shoring frame 11. In lieu of using tabs 48, light gage metal straps (not shown) can be disposed about the uppermost brace 32 and secured to the tabs 46.

Each height adjustment means further includes a screw 50 welded to the support 38 and threadably disposed through a nut 52 which is rotatably carried on top of the adjacent tubular element 40 whereby rotation of the nuts 52 is operative to raise and lower the support 38 for raising and lowering the associated slab form 14.

The adjustment structure 10 also includes beam form support means 54 adapted for removable connection to the bottom angle 26 of the beam form 12. The beam form support means 54 includes a pair of transversely spaced apart, depending straps 56 removably secured to the beam form bottom channel 26 by suitable fasteners 58. The lower ends of the straps 56 are welded to a hinge structure comprising a transversely oriented hinge pin 60 defing a transverse pivot axis about which the shoring frame 11 is adapted to pivot, as will be seen.

The hinge pin 60 is pivotally received within a plurality of U-shaped keepers or hinge knuckles 62 welded to the upper surface of a transversely oriented load bearing I-beam 64. The opposite ends of the I-beam 64 are welded to the pair of tubular elements 40. The beam 64 thus supports the depending portions 42. If desired, additional pairs of depending portions 42 (not shown) may be mounted to the transverse beam 64 at different spacings so that the pairs would be adapted to fit within the upper tubular extremities of shoring frame legs 28 located at different spacings. One pair of portions 42 would adapt the structure 10 to a shoring frame having its legs 28 spaced four feet apart, for example, and another pair of portions 42 would, for example, fit within legs 28 spaced apart five feet.

The I-beam 64 comprises the primary load bearing member for bearing the weight of the beam form 12 and the poured concrete. Without it the usual shoring frame 11 would be incapable of supporting the beam form and the weight of the poured concrete.

The lateral position of the beam form 12 relative to the tubular elements 40 is adjusted by a lateral adjusting means comprising a threaded transverse rod 66 having a tuning nut 68 welded to one end. The rod 66 extends through a threaded nut which is welded to a L-shaped bracket 72 whereby rotation of the turning nut 68 moves the threaded rod 66 transversely. The opposite end of threaded rod 66 is disposed through a guide opening in an angle or bracket 74 fixed to the side of the I-beam 64. In addition, a pair of threaded nuts 76 are welded to the rod 66 in transversely spaced apart relation and function as stops for engagement with opposite edges or sides of an engager 78.

Figure 5:
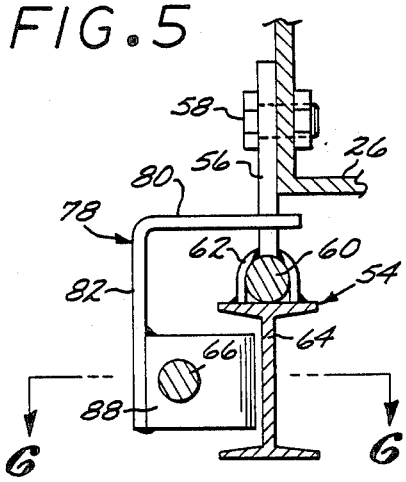
FIG. 5 is an enlarged view taken along the line 5—5 of FIG. 4.
Figure 6:
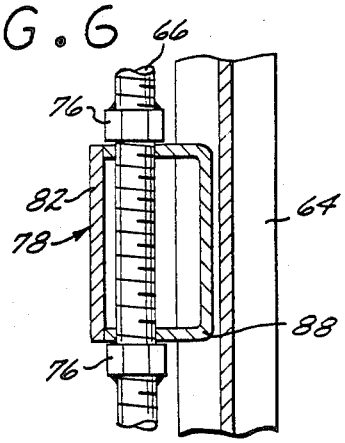
FIG. 6 is a view taken along the line 6—6 of FIG. 5.

As best seen in FIGS. 5 and 6, the engager 78 is operative to move the beam form 12 laterally or sideways, while yet enabling pivotal movement of the shoring frame 11 relative to the beam form 12.

More particularly, the engager 78 includes a horizontally disposed upper leg 80 which projects inwardly between the spaced apart straps 56 attached to the beam form 12. The leg 80 is attached to a vertical leg 82 which is attached to a U-shaped channel 88 to define a box structure having side apertures for rotatably receiving the rod 66. As will be apparent, rotation of the turning nut 68 causes the nut 76 to bear against the ends of the box-like structure to urge the upper leg 80 against the adjacent edges of the beam form straps 56 for lateral movement of the beam form. However, as will be seen, on lowering of the shoring frame 11, the frame 11 will be free to rotate about the transverse axis defined by the hinge pin 60.

The vertical height of the shoring frame 11 can be adjusted by rotating pair of adjustment nuts 33 rotatably carried at the lower ends of the frame legs 28. Each nut 33 is part of a typical screw jack arrangement which includes a screw 35 having a foot 36 at its lower end for engagement with the supporting surface. The screw 35 is threaded through an associated nut 33, and passes into the hollow interior of the associated frame leg 28. Rotation of the nuts 33 in the proper direction increases or decreases the height of the legs 28 for adjustment of the height of the beam form 12, as will be seen.

As best seen in FIGS. 2 and 3, the shoring frame 11 is braced in the vertical, supporting position illustrate in FIG. 2 by means of a push-pull system comprising a brace of jack 90 which extends diagonally from the end shoring frame 11 under discussion to a beam form bottom angle 26 located inwardly of the end frames 11. The jack 90 can also be used to adjust the longitudinal position of the beam form 12 for proper mating with the columns 16.

Each jack 90 comprises an elongated tubular sleeve or element 92 threaded at its opposite extremities to screws 94 and 96. The screw 94 is pivotally secured to a bracket 98 secured to the mid portion of any inward bottom angle 26,, and the other screw 96 is pivotally attached to a bracket 100 which is welded to the mid portion of a transverse channel 102.

The opposite ends of channel 102 are welded to plates 104 adapted for engagement with the insides of the frame legs 28. A pair of clamping brackets 106 are located opposite the plates 104, respectively. Each bracket 106 has an arcuate mid portion to fit around the outside of a leg 28, and a pair of apertured side portions to receive fasteners which extend through the brackets 106 and into suitable openings in the plates 104. This removable clamps the jack 90 to the shoring frame 11. The jack 90, like the remainder of the present structure 10, is thus adapted for detachable association with the usual or standard shoring frame 11 in order to suit it for the special purposes herein described.

By rotation of the element 92 in the proper direction, the longitudinal position of the beam form 12 can be adjusted slightly, as previously mentioned. In addition, the bolt attaching the screw 94 to the bracket 98 can be removed, allowing the jack 90 to pivot upon bracket 100. The jack 90 can then be folded upwardly underneath the beam form 12 to enable the associated shoring frame 11 to be pivoted upwardly to its horizontal "flying" or moving position. Suitable latching means (not shown) may be used to secure or latch the shoring frames 11 to the beam form in this moving position.

During concrete pouring, additional diagonal shoring braces 108 may be used, as desired, to further brace the frame legs 28 in position.

After the longitudinal and transverse position of the beam form 12 is adjusted relative to the columns 16 by operation of the jacks 90 and the screw nuts 33, and the height of the slab forms 14 is adjusted relative to the beam forms 12 by operation of the nus 52, the beam form 12 is connected to the column form so that both the column and the beam can be poured at the same time. The shoring frames 11 at the ends of the beam form provide such adjustments and connections. The intermediate shoring frames 11 carry a modified structure 10a, as seen generally in FIG. 2, which is substantially identical to the previously described structure 10, except that it does not embody any alteral adjustment means for the beam form 12. Instead, each intermediate adjustment structures **10*a* provides vertical adjustment for the slab forms 13 and pivotal mounting of the associated shoring frame 11. Beam form adjustment by the structure 10** is necessary only at the ends of the beam form.

The connection between the beam form 12 and an adjacent slab form 13 is provided by bridging filler strips or the like (not shown) positioned between the adjacent edges of the forms to provide a continuous slab form assembly.

After the concrete has been poured and allowed to cure to form the floor slab and beam, any auxilliary shoring posts (not shown) are removed. The nuts 52 are next operated to lower the supports 28 and I-beams 18 away from the slab forms 14. The lowering continues until the I-beams 18 rest upon a plurality of stringer support arms 110 which are spaced along the length of the beam form 12 and attached to brackets which are attached to the beam form side channels 24.

Lowering of the supportsd 28 is continued until they are clear of the I-beams 18. All of the cross braces 108 are then removed and the jacks 90 are disconnected. Two fork lifts (not shown) carrying beam dollies are located beneath the beam form 12. The usual beam dolly has four swivel casters on the bottom and a side structure to keep the beam form 12 from tipping when it is raised, lowered or transported.

Each beam form 12 includes a pair of brackets 114 mounted on opposite sides to the side channels 24 and constituting stripping saddles. Hydraulic jacks 112 are placed on the brackets 114 and operated to separate the beam form 12 from the pured beam. The fork lifts then lower the beam dollies and the beam form 12 to the floor.

From the foregoing it will be apparent that the present beam form and slab form adjustment structure 10 enables rapid and accurate location of a beam form at the proper height and in proper alignment with the centerlines of associated building columns. It also enables the beam and slab forms to be flown or otherwise transported to subsequent pouring stations for reuse. Of particular importance, however, is that these function are accomplished by using readily available shoring frames, modified by the addition of structures 10. The structures 10 are uniquely capable of adapting such shoring frames to beam form and slab form height and alignment adjustment, without recourse to use of special purpose shoring frames.

Various modifications and changes may be made with regard to the foregoing detailed description without departing from the spirit of the invention or the scope of the following claims.

I claim:

1. A beam form and slab form adjustment structure adapted for mounting to a shoring frame having a pair of upstanding tubular legs, said structure comprising:

longitudinally extending beam form support means includig first hinge means;

an elongated transverse beam including second hinge means cooperative with said first hinge means to define a transverse pivot axis located above said beam and to enable upward pivotal movement of said transverse beam toward said beam form support means and about said transverse axis to facilitate transport of said beam form support means to a different site;

lateral adjustment means operative upon said transverse beam and said beam form support means for adjusting the lateral position of said beam form support means relative to said transverse beam;

a pair of slab form support means carried by said transverse beam and including a pair of supports for engaging slab forms and a pair of height adjusting means mounting said supports, respectively; and depending portions supported by said transverse beam and telescopably and removably receivable within the upper ends of said legs of said shoring frame, respectively, said pair of height adjustment means being operable to adjust the vertical position of said pair of supports relative to said depending portions said depending portions being operative to transfer loads from said transverse beam to said shoring frame solely through said upper ends of said legs.

2. A beam form slab form adjustment structure according to claim 1 wherein each of said height adjustment means comprises a screw mounting one of said supports, a threaded nut rotatably carried by an associated one of said depending portions and threadedly engaging the associated screw whereby rotation of said nut is operative to raise and lower the associated one of said supports for raising and lowering slab forms.

3. A beam form slab form adjustment structure according to claim 1 wherein said first hinge means comprises a transverse hinge pin defining said transverse axis, and said second hinge means comprises a plurality of hinge knuckles pivotally receiving said hinge pin.

4. A beam form slab form adjustment structure according to claim 1 wherein said beam comprises a structural I-beam adapted to bear the load of the superjacent portion of a beam form filled with concrete.

5. A beam form slab form adjustment structure according to claim 3 wherein said first hinge means includes transversely spaced apart, depending straps; and said lateral adjusting means comprises a threaded transverse rod, anchorages fixed to said beam and threadedly receiving said rod, spaced apart stops fixed to said rod, and an engager supported by said rod and extending between said straps whereby rotation of said rod moves said engager against one or the other of said straps to move said beam form support means transversely.

6. A beam form slab form adjustment structure according to claim 1 and including push-pull means comprising an elongated brace pivotally connected at one extremity to said beam form support means in longitudinally spaced apart relation to said first and second hinge means; a transverse member having end fittings for detachable mounting of its extremities to the shoring frame legs, respectively; and pivot means connecting the opposite extremity of said brace to said transverse member whereby operation of said push- pull means moves said beam form support means relative to the shoring frame along the longitudinal axis of said beam form support means.

7. A beam form and slab form adjustment structure adapted for mounting to a shoring frame having a pair of upstanding tubular legs, said structure comprising:

a pair of slab supports for engaging slab forms;

a pair of screw means operative to raise and lower said slab supports, respectively;

beam form support means including a hinge pin;

a transverse load bearing beam supporting said pair of screw means and including hinge knuckles pivotally receiving said hinge pin and defining a transverse pivot axis above said beam to enable upward pivotal movement of said beam toward said beam form support means to facilitate transport of said beam form support means to a different site;

screw means operative upon said transverse beam and said beam form support means for adjusting the lateral position of said beam form support means relative to said beam; and a pair of depending elements carried by said beam and telescopably and removably receivable within the upper ends of said legs of said shoring frame, said depending elements being operative to transfer loads from said beam to said shoring frame solely through said upper ends of said legs.

8. A beam form and slab form adjustment structure adapted for mounting to a shoring frame having a pair of upstanding tubular legs, said structure comprising:

longitudinally extending beam form support means including first hinge means having a transverse hing pin defining a transverse axis, said first hinge means further having transversely spaced apart, depending straps;

transverse beam means including second hinge means having a plurality of hinge knuckles pivotally receiving said hinge pin of said first hinge means to enable pivotal movement of said beam means relative to said beam form support means and about said transverse axis;

lateral adjustment means including a threaded transverse rod, spaced apart stops fixed to said rod, and an engager supported by said rod and extending between said straps whereby rotation of said rod moves said engager against one or the other of said straps to move said beam form support means for adjusting the lateral position of said beam form support means relative to said beam means;

a pair of slab form support means carried by said transverse beam means and including a pair of supports for engaging slab forms and a pair of height adjusting means mounting said supports, respectively; and depending portions supported by said transverse beam means and telescopably and removably receivable within the upper extremities of said legs of said shoring frame, respectively, said pair of height adjustment means being operable to adjust the vertical position of said pair of supports relative to said depending portions.

9. A beam form and slab form adjustment structure adapted for mounting to a shoring frame having a pair of upstanding tubular legs, said structure comprising:

longitudianlly extending beam form support means including first hinge means;

transverse beam means including second hinge means cooperative with said first hinge means to enable pivotal movement of said beam means relative to said beam form support means and about a transverse axis;

lateral adjustment means forming a structure separately of said first and second hinge means, and operative upon said first hinge means for adjusting the lateral position of said beam form support means relative to beam means;

a pair of slab form support means carried by said transverse beam means and including a pair of supports for engaging slab forms and a pair of height adjusting means mounting said supports, respectively; and depending portions supported by said transverse beam means and telescopably and removably receivable within the upper extremities of said legs of said shoring frame, respectively, said pair of height adjustment means being operable to adjust the vertical position of said pair of supports relative to said depending portions.

10. In combination with a shoring frame having a pair of upstanding tubular legs, an improved beam form adjustment structure comprising:

longitudinally extending beam form support means;

an elongated, transversely disposed beam having opposite extremities which include depending portions removably receivable upon and bearing against the upper ends of said legs of said shoring frame, respectively, and operative to transmit loads from said beam to said shoring frame solely through said upper ends of said legs, whereby said shoring frame can be separated from said beam for separate use of said shoring frame;

separate hinge means defining a transverse pivot axis offset from said beam and attached to said beam form support means and to said beam, whereby said beam is hingedly carried by said beam form support means for transport therewith to a different site, and whereby said beam can be upwardly pivoted about said transverse axis and toward said beam form support means to facilitate said transport; and lateral adjustment means operative for adjusting the lateral position of said beam form support means relative to said beam.

* * * * *

UNITED STATES PATENT AND TRADEMARK OFFICE

CERTIFICATE OF CORRECTION

PATENT NO. : 4,693,449

DATED : September 15, 1987

INVENTOR(S) : Arthur L. Cunningham

It is certified that error appears in the above-identified patent and that said Letters Patent is hereby corrected as shown below:

Column 2, line 31, after "FIG. 3 is" insert --a view--;
Column 3, line 34, delete "dicks" and insert --decks--;
line 56, delete "not" and insert --nor--;
line 65, delete "from" and insert --form--;
Column 4, line 58, after "threaded nut" insert --70--;
Column 5, line 32, delete "of" and insert --or--;
line 53, delete "removable" and insert --removably--;
Column 6, line 8, delete "nus" and insert --nuts--;
line 16, delete "alteral" and insert --lateral--;
line 50, delete "pured" and insert --poured--;
Column 7, lines 36, 44, 49, 53 and 63, after "beam form" insert --and--; and
Column 8, line 37, delete "hing" and insert --hinge--.

Signed and Sealed this

Twenty-ninth Day of March, 1988

*Attest:*

DONALD J. QUIGG

*Attesting Officer*

*Commissioner of Patents and Trademarks*